US008264714B2

(12) United States Patent
Matsui et al.

(10) Patent No.: US 8,264,714 B2
(45) Date of Patent: Sep. 11, 2012

(54) SHEET CONVEYANCE SYSTEM, CONTROL PROGRAM THEREOF, AND SHEET CONVEYANCE METHOD

(75) Inventors: Noriaki Matsui, Abiko (JP); Hidenori Sunada, Toride (JP); Mitsuhiko Sato, Kashiwa (JP); Mitsushige Murata, Kashiwa (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 1318 days.

(21) Appl. No.: 11/374,197

(22) Filed: Mar. 14, 2006

(65) Prior Publication Data

US 2007/0188794 A1 Aug. 16, 2007

(30) Foreign Application Priority Data

Mar. 28, 2005 (JP) ..... 2005-091855

(51) Int. Cl.

| | |
|---|---|
| ***G06F 3/12*** | (2006.01) |
| ***G03G 15/00*** | (2006.01) |
| ***B65H 5/22*** | (2006.01) |
| ***B65H 83/00*** | (2006.01) |
| ***B65H 5/00*** | (2006.01) |

(52) U.S. Cl. ..... 358/1.15; 358/435; 358/436; 399/361; 271/3.01; 271/3.14; 271/264

(58) Field of Classification Search ..... 358/1.15
See application file for complete search history.

(56) References Cited

U.S. PATENT DOCUMENTS

| | | | | |
|---|---|---|---|---|
| 4,924,320 | A | 5/1990 | Tanaka et al. | 358/296 |
| 5,509,050 | A * | 4/1996 | Berland | 455/557 |
| 6,147,765 | A * | 11/2000 | Yoneda | 358/1.15 |
| 6,151,137 | A * | 11/2000 | Henrick | 358/434 |
| 6,456,399 | B1 * | 9/2002 | Ho et al. | 358/404 |
| 6,570,676 | B1 * | 5/2003 | Sebestyen | 358/425 |
| 7,046,392 | B2 * | 5/2006 | Shibata et al. | 358/1.9 |
| 7,196,713 | B1 * | 3/2007 | Yamagishi | 347/116 |
| 7,230,733 | B2 * | 6/2007 | Adegawa | 358/1.15 |
| 7,283,269 | B2 * | 10/2007 | Tanimoto | 358/1.15 |
| 7,343,400 | B2 * | 3/2008 | Demoto et al. | 709/219 |
| 7,420,697 | B2 * | 9/2008 | Nakahara | 358/1.15 |
| 7,489,416 | B2 * | 2/2009 | Ishikawa | 358/1.16 |
| 7,751,076 | B2 * | 7/2010 | Murata et al. | 358/1.15 |
| 7,869,077 | B2 * | 1/2011 | Ohara et al. | 358/1.16 |
| 2002/0140967 | A1 * | 10/2002 | Tsuboi et al. | 358/1.15 |
| 2003/0098992 | A1 * | 5/2003 | Park et al. | 358/1.15 |
| 2003/0102622 | A1 | 6/2003 | Johnson et al. | 271/25 |
| 2004/0021266 | A1 | 2/2004 | Mizuta et al. | 271/303 |

(Continued)

FOREIGN PATENT DOCUMENTS

| | | |
|---|---|---|
| JP | 9-222961 | 8/1997 |

(Continued)

*Primary Examiner* — Hilina S Kassa
(74) *Attorney, Agent, or Firm* — Fitzpatrick, Cella, Harper & Scinto

(57) ABSTRACT

In a sheet conveyance system in which a plurality of apparatuses each including a communication unit with a plurality of communication channels are connected, and a sheet is conveyed between the apparatuses, each of the plurality of communication channels can be switched between a transmission mode and a reception mode. When a plurality of transmission channels are set by channel assignment, communication can be executed by giving a priority to each transmission destination. If transmission data are accumulated in an apparatus, and they include data for a transmission destination with a higher priority over the current data transmission destination, the number of transmission channels is increased, and the priority is raised.

8 Claims, 14 Drawing Sheets

U.S. PATENT DOCUMENTS

2005/0206068 A1 9/2005 Sasaki et al. ..... 271/98
2005/0225803 A1* 10/2005 Enomoto ..... 358/1.18
2005/0232031 A1* 10/2005 Fukano ..... 365/189.05
2006/0061032 A1 3/2006 Kamiya et al. ..... 271/221
2006/0209874 A1* 9/2006 Nagata ..... 370/445
2006/0261543 A1 11/2006 Miyake et al. ..... 271/292

FOREIGN PATENT DOCUMENTS

JP 11348351 A * 12/1999
JP 9-222961 6/2003

* cited by examiner

SHEET CONVEYANCE SYSTEM, CONTROL PROGRAM THEREOF, AND SHEET CONVEYANCE METHOD

FIELD OF THE INVENTION

The present invention relates to a sheet conveyance system for conveying a sheet between a plurality of apparatuses, a control program thereof, and a sheet conveyance method.

BACKGROUND OF THE INVENTION

Conventionally, systems and methods of conveying a sheet between a plurality of apparatuses are known. In such sheet conveyance systems, generally, sheet conveyance is controlled while executing data communication between the apparatuses.

A sheet conveyance system has recently been proposed, which connects a plurality of apparatuses over a network and causes each apparatus to directly transmit/receive commands to/from a plurality of apparatuses regardless of whether the apparatus is an adjacent apparatus (Japanese Patent Laid-Open No. 9-222961). A network sheet conveyance system of this type is superior to a conventional one-to-one connection system because a communication delay need not be taken into consideration.

More specifically, the network sheet conveyance system includes a plurality of apparatuses to execute communication by using a plurality of communication channels each of which is set in one of the transmission mode and a reception mode. A sheet is conveyed between the plurality of apparatuses.

However, the network sheet conveyance system has no sufficient measures against reception overflow that is caused due to transmission concentration from the apparatuses to a specific one. For transmission data of some types, the speed of command response is too low.

SUMMARY OF THE INVENTION

The present invention has been proposed to solve the conventional problems, and has as its object to efficiently and effectively transmit/receive data in a sheet conveyance system which includes a plurality of apparatuses to execute communication by using a plurality of communication channels each of which is set in one of a transmission mode and a reception mode, and conveys a sheet between the apparatuses.

In order to achieve the above object, a sheet conveyance system, sheet conveyance method, and control program of the sheet conveyance system according to the present invention are mainly characterized by the following arrangements.

According to the present invention, the foregoing object is attained by providing a sheet conveyance system which includes a plurality of apparatuses to execute communication by using a plurality of communication channels each of which is set in one of a transmission mode and a reception mode, and conveys a sheet between the apparatuses, each of the apparatuses comprising:

control means for controlling the plurality of communication channels in accordance with one of a data type and the number of partner apparatuses as a data transmission/reception target.

According to another aspect of the present invention, the foregoing object is attained by providing a sheet conveyance method of conveying a sheet between a plurality of apparatuses to execute communication by using a plurality of communication channels each of which is set in one of a transmission mode and a reception mode, comprising:

a control step of controlling, in each of the plurality of apparatuses, the plurality of communication channels in accordance with one of a data type and the number of partner apparatuses as a data transmission/reception target.

According to another aspect of the present invention, the foregoing object is attained by providing a control program of a sheet conveyance system which includes a plurality of apparatuses to execute communication by using a plurality of communication channels each of which is set in one of a transmission mode and a reception mode, and conveys a sheet between the apparatuses, comprising:

causing each of the apparatuses to execute a control step of controlling the plurality of communication channels in accordance with one of a data type and the number of partner apparatuses as a data transmission/reception target.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. The constituent elements described in the embodiments are merely examples and do not limit the scope and spirit of the present invention.

First Embodiment

A sheet conveyance system according to the first embodiment of the present invention will be described. A copying machine which serves as an image forming apparatus having an image reading device provided in the main body will be described on the basis of the accompanying drawings. This sheet conveyance system employs a communication control method using a network communication chip which is used in POD-based system products.

Figure 1:
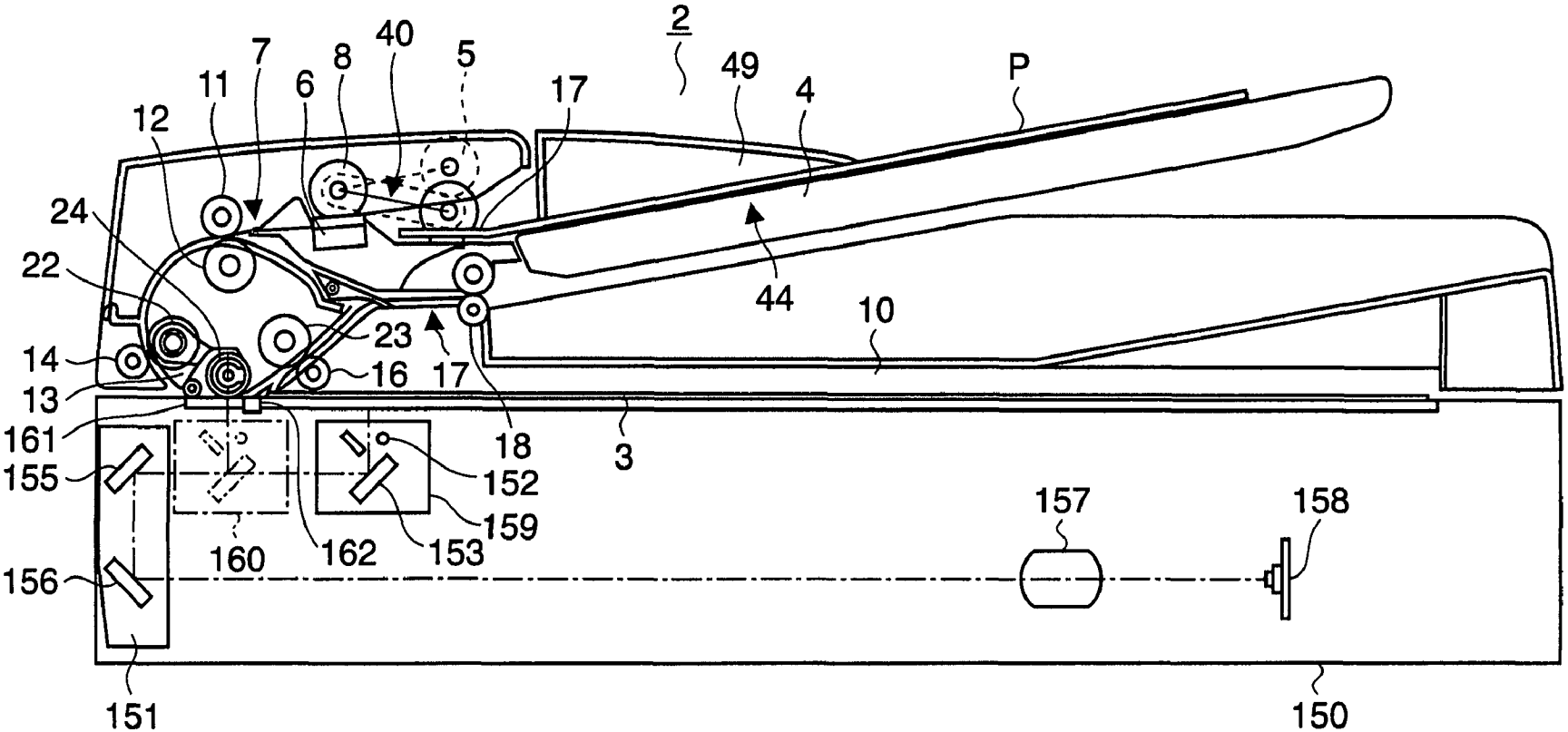
FIG. 1 is a view for explaining the arrangement of an image reading device and a document processing device according to an embodiment.
Figure 2:
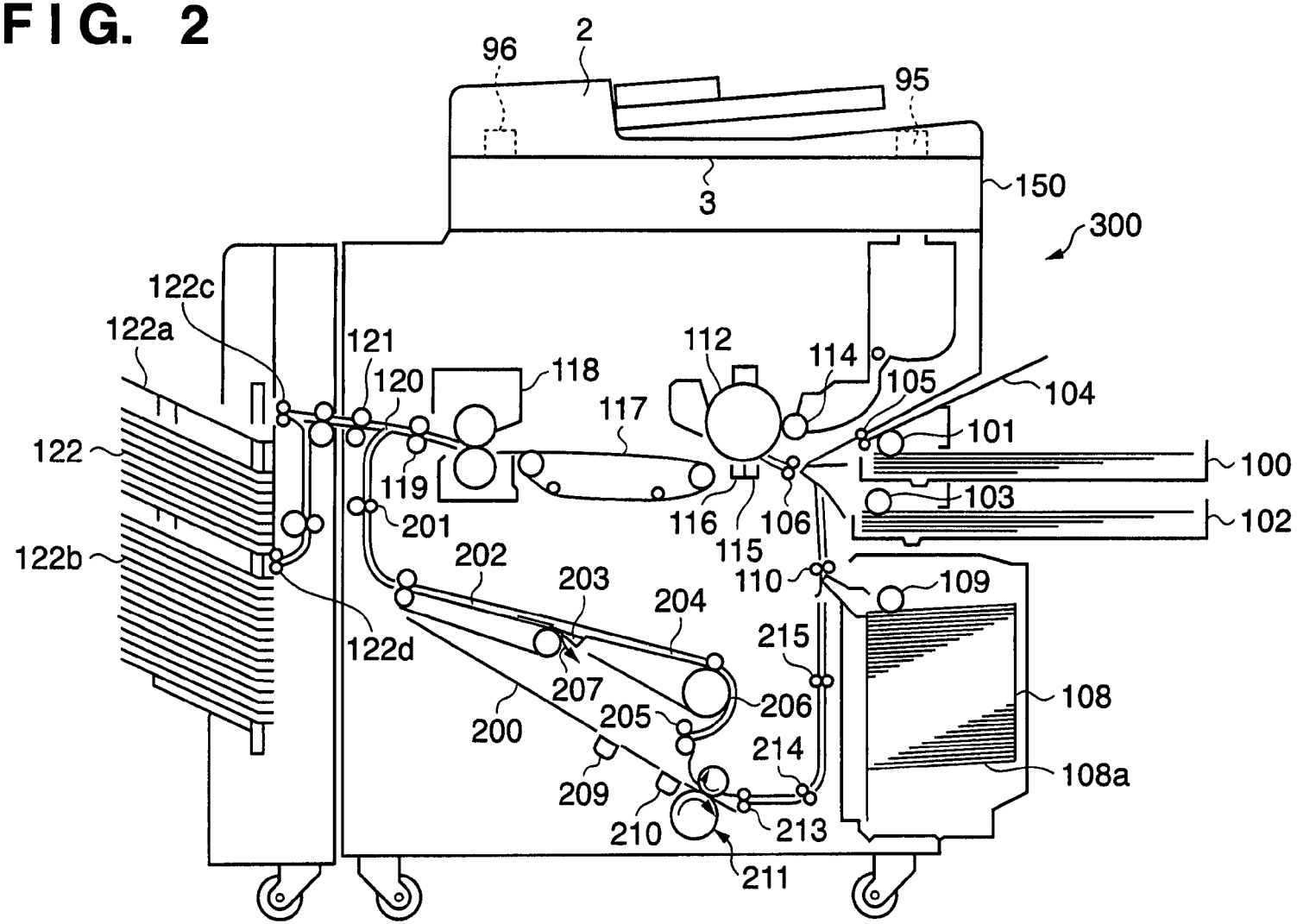
FIG. 2 is a view for explaining the arrangement of an image forming apparatus according to the embodiment.

FIG. 1 is a view showing the arrangement of an image reading device including a reader unit 150 and a document processing device (ADF) 2. FIG. 2 is a view showing a copying machine which serves as an image forming apparatus including the image reading device as a part shown in FIG. 1.

[Reader Unit]

The reader unit 150 has a lamp 152 which irradiates a document surface with light, and mirrors 153, 155, and 156 which guide reflected light from a document P, which corresponds to the light emitted from the lamp 152, to a lens 157 and CCD 158. The lamp 152 and mirror 153 are attached to a first optical bench 159. The mirrors 155 and 156 are attached to a second optical bench 151.

Reflected light from the document is guided to the lens 157 via the mirrors 153, 155, and 156 and focused on the CCD 158 through the lens 157. The CCD 158 photoelectrically converts the reflected light reflecting document information and outputs the light as an electronic image signal.

In this arrangement, document information can be read in two modes: a flow scanning mode wherein document information is read while keeping the first optical bench 159 stopped at a document reading position 160 and causing the ADF 2 to convey a document, and an ADF scanning mode wherein document information is read while stationarily mounting a document on a document table glass 3 and moving the optical benches 159 and 151 in the sub-scanning direction.

[Document Processing Device]

The document processing device 2 is provided above the reader unit 150 to open with respect to a platen glass 161 and document table glass 3 through a hinge mechanism. The document processing device 2 will be described below in detail.

Referring to FIG. 1, a document tray 4 carries the sheet-shaped document P. A pair of widthwise regulating plates are arranged on the document tray 4 to be slidable in the widthwise direction of the document. The conveyance stability in feed can be ensured by regulating, by the widthwise regulating plates, the widthwise direction of the document P placed on the document tray 4.

A feed roller 5 is provided above the document tray 4. The feed roller 5 rotates and feeds the sheet document as a separation conveyance roller 8 is rotated. The feed roller 5 normally retracts to the upper side (the position indicated by the dotted line in FIG. 1), i.e., home position not to impede the document set operation. When the feed operation starts, the feed roller 5 moves downward to the position indicated by the solid line in FIG. 1 and abuts against the upper surface of the document P. The feed roller 5 which is axially supported by an arm (not shown) can be moved vertically by swinging the arm.

A separation pad 6 is arranged on the opposing side of the separation conveyance roller 8 to apply a pressure to the side of the separation conveyance roller 8. The separation pad 6 is formed from, e.g., a rubber material having a friction slightly lower than that of the separation conveyance roller 8. Each document P fed by the feed roller 5 is separated by the separation pad 6 and fed by the separation conveyance roller 8.

A registration roller 12 and registration idler roller 11 serve as a registration means for aligning the leading edge of the document fed by the separation unit. The leading edge of the separated document is made to abut against the nip portion of the registration roller pair 11 and 12 at rest to form a loop of the document so that the leading edge is aligned.

The document is conveyed to the platen glass 161 by a read roller 22 and read idler roller 14. When the leading edge reaches the read roller 22, and the document starts being conveyed to the platen glass 161, the image is read by the reading unit 160 while conveying the document by a platen roller 24 and read discharge roller 23. The document which was conveyed to the platen glass 161 and underwent image reading is brought up by a lifter 162 and conveyed by the read discharge roller 23 and read discharge idler roller 16. When image reading is ended, the document is discharged to a discharge tray 10 by discharge rollers 18.

In a double-sided mode, the document is not discharged by the discharge rollers 18 but switched back, guided to the upper sheet path, and conveyed to the registration rollers 11 and 12. When the document reaches the registration rollers 11 and 12, the reverse surface of the document is read in the same way as described above.

The document tray 4 has a document set sensor 40 serving as a transmission optical sensor to detect that the sheet document P is set. A sheet width sensor 44 which detects the widthwise length of a bundle of documents P set on the document tray 4 by detecting the positions of the side guides is provided on the lower side of the document tray 4.

A registration sensor 7 serving as a transmission photosensor 7 to detect the document P is provided between the separation roller 8 and the registration roller 12. The registration sensor 7 detects the leading edge of the separated and fed document and the timing to control the abutting amount (loop amount) to the registration roller 12.

A read sensor 13 serving as a reflection photosensor to detect the document is provided immediately after the read roller 22 to generate a reference signal for the image reading start timing in the reading unit 160. A discharge sensor 17 serving as a transmission photosensor to detect the document is provided immediately before the discharge rollers 18 to detect, e.g., the document discharge timing.

Figure 3:
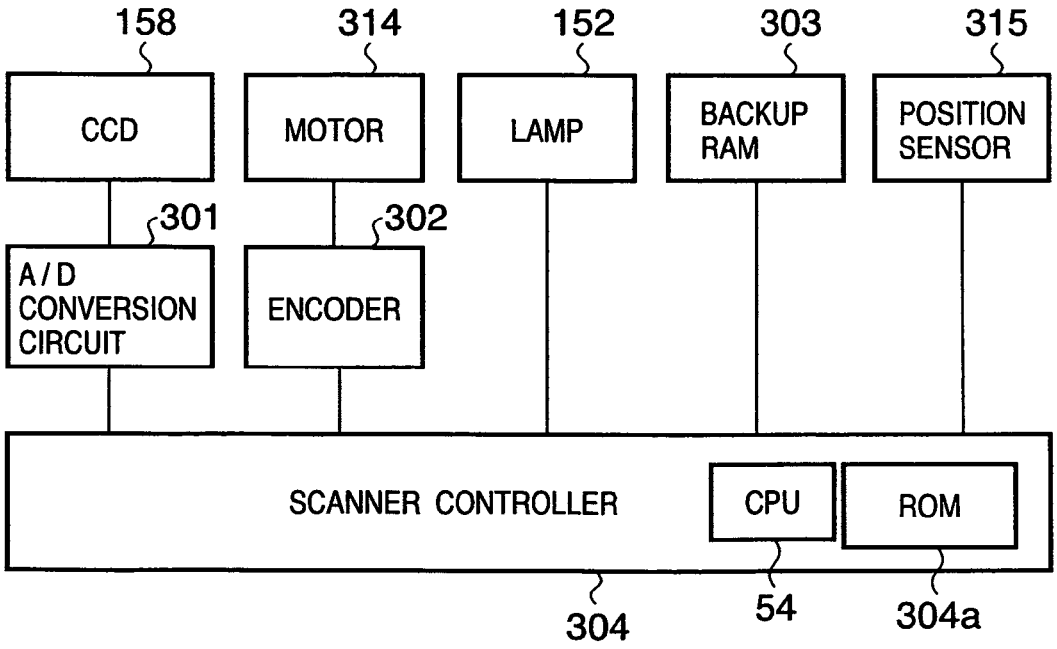
FIG. 3 is a control block diagram of the reading device according to the embodiment.

FIG. 3 is a block diagram showing the schematic arrangement of the control system of the reader unit. The control system comprises a lamp 152, motor 314, CCD 158, A/D conversion circuit 301, encoder 302, position sensor 315, backup RAM 303, and scanner controller 304. The lamp 152 irradiates the document surface with light. The motor 314 moves the optical benches 159 and 151 in the sub-scanning direction and scans the document. The CCD 158 photoelectrically converts reflected light from the document surface. The A/D conversion circuit 301 A/D-converts the output signal from the CCD 158. The encoder 302 is connected to the motor 314. The position sensor 315 positions the optical bench 159 to the home position. The backup RAM 303 sets the normal document reading position in the ADF scanning mode. The scanner controller 304 incorporates a CPU 54 and ROM 304*a*. Processing of positioning the optical bench 159 is executed by the CPU 54 in accordance with information in the ROM 304*a*.

The optical benches 159 and 151 are coupled to the motor 314 by a wire 154 (not shown) and moved in parallel to the document table glass 3 by rotating the motor 314. The position sensor 315 detects the home position of the first optical bench 159. The optical benches 159 and 151 are moved to optically scan the document on the document table glass 3 by rotating the motor 314 in the forward or reverse direction with reference to the position of the position sensor 315.

The motor 314 includes a stepping motor. The encoder 302 is connected to the motor 314. The number of pulses corresponding to the moving distance of the optical benches 159 and 151 can be recognized by the output from the encoder 302. That is, the position of the optical benches 159 and 151 can be grasped by the position sensor 315 and the encoder pulse from the encoder 302.

Figure 4:
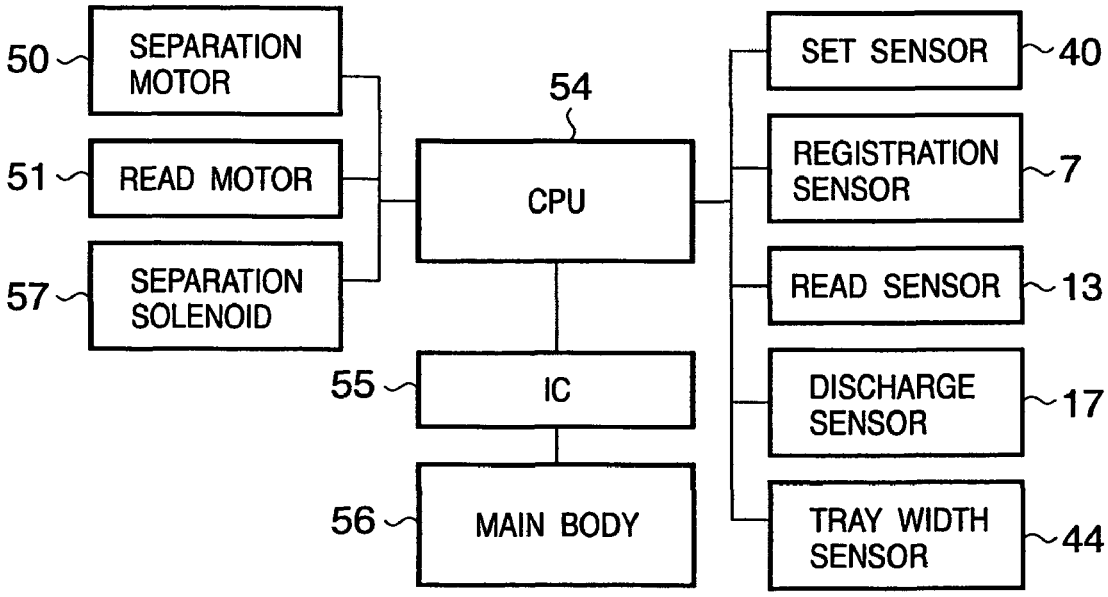
FIG. 4 is a control block diagram of the document processing device according to the embodiment.

FIG. 4 is a block diagram showing the circuit arrangement of the control system of the document processing device. The control circuit mainly includes the microprocessor (CPU) 54. Drive circuits of various kinds of loads and sensor signals are connected to the input/output ports of the CPU 54.

The control circuit also comprises a RAM backed up by a battery (not shown) and a ROM which stores control sequence software. A communication IC 55 controls data communication with the copying machine main body.

Each of a separation motor 50 and read motor 51 is driven by a stepping motor driver. Each driver receives a phase excitation signal and motor current control signal from the CPU 54. A separation solenoid 57 is driven by a driver. The operation of the separation solenoid 57 is controlled by a signal connected to the input/output port of the CPU 54.

Various kinds of sensors such as the registration sensor 7, set sensor 40, read sensor 13, discharge sensor 17, and tray width sensor 44 are connected to the input ports of the CPU 54 and used to monitor the behaviors of a document and movable loads in the apparatus.

Figure 5:
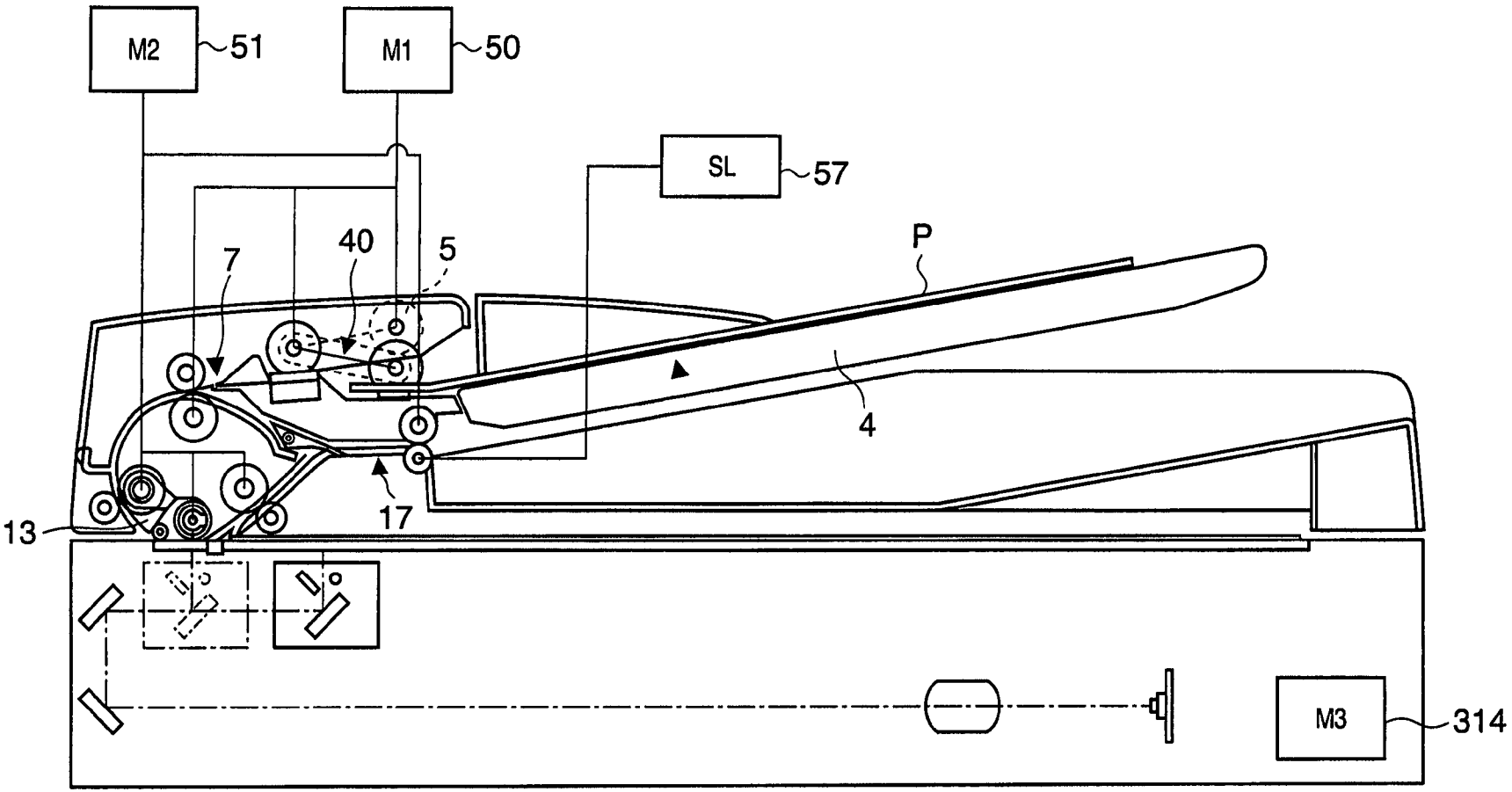
FIG. 5 is a view for explaining the driving system of the document processing device according to the embodiment.

A driving system to drive the rollers and the like will be described with reference to FIG. 5. The separation motor 50 is a stepping motor which rotates in the forward and reverse directions to separate and convey a document. When the separation motor 50 rotates in the feeding direction, the feed roller 5 moves downward from the above (position indicated by the broken line in FIG. 5), i.e., home position, abuts against the uppermost sheet of the sheet documents on the document tray 4, and drives the feed roller 5 and separation roller 8.

When the separation motor 50 rotates in the conveyance direction reverse to the feeding direction, the feed roller 5 is brought up and held to the above (position indicated by the broken line in FIG. 5), i.e., home position, and the registration roller 12 is driven. The read motor 51 is a stepping motor to drive the read roller 22, platen roller 24, read discharge roller 23, and discharge rollers 18. The rollers are driven at a speed to read the image of the conveyed document. The separation solenoid 57 presses or separates the idler roller of the discharge rollers 18 in switching back a double-sided document.

Figure 6:
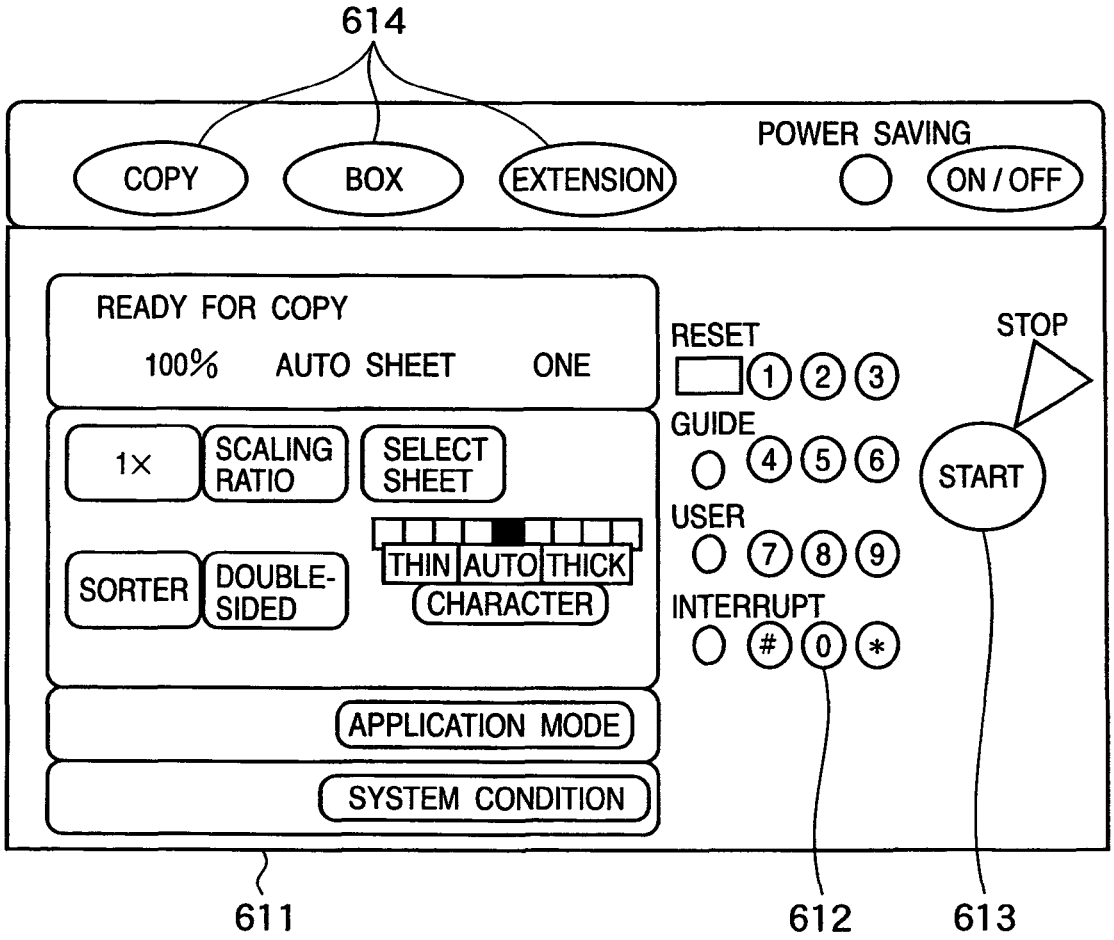
FIG. 6 is a view showing an operation unit according to the embodiment.

FIG. 6 is a plan view showing an example of an operation panel provided in the reader unit 150 shown in FIG. 1. Referring to FIG. 6, a display unit 611 displays an operation status or message. The surface of the display unit 611 is made of a touch panel which functions as select keys in response to touch on the surface. A scaling ratio or the like is set here. A ten-key pad 612 is used to input numbers. The number of copies of one document is set here. A start key 613 is pressed to start the document reading operation.

Function keys 614 allow one-touch switching between the copy operation, the BOX operation, and the extended function. The BOX operation is processing of accumulating scanned images in a hard disk (not shown) prepared in the main body.

[Printer Unit]

FIG. 2 is a view showing the arrangement of a printer unit 300. Reference numeral 100 denotes an upper cassette. Every sheet in the cassette is separated and fed by the function of a separation grip and a feed roller 101 and guided to registration rollers 106. Reference numeral 102 denotes a lower cassette 102. Every sheet in the cassette is separated and fed by the function of a separation grip and a feed roller 103 and guided to the registration rollers 106. Instead of the upper cassette 100 or lower cassette 102, a feed unit (=deck) may be attached. This arrangement includes only the engine and can also connect a deck.

Reference numeral 104 denotes a manual feed guide which guides every sheet material to the registration rollers 106 through rollers 105. A sheet loader 108 (deck type) has an intermediate plate 108*a* to be moved vertically by, e.g., a motor. Every sheet on the intermediate plate is separated and fed by the function of a feed roller 109 and a separation grip and guided to conveyance rollers 110.

A photoreceptor 112, developing unit 114, transfer charger 115, and separation charger 116 construct an image forming unit. Reference numeral 117 denotes a conveyor belt to convey a sheet material with an image being formed on it; 118, a fixing unit; 119, conveyance rollers; and 120, a diverter. The sheet material with an image being formed on it is guided to discharge rollers 121 by the diverter 120 and conveyed into a sorter 122. The sorter 122 has a non-sort tray 122*a*, sort bin tray 122*b*, non-sort tray discharge roller 122*c*, and sort bin tray discharge roller 122*d*. The non-sort tray and sort bin tray move in the vertical direction to sort sheets to every stage. A discharge tray may be attached in place of the sorter. This arrangement includes only the engine and sorter and can also connect an inserter, stacker, and finisher.

In the double-sided or multiple copy mode, the sheet after fixing is diverted by the diverter 120 and conveyed by conveyance rollers 201. In the double-sided copy mode, the sheet is discharged to an intermediate tray 200 through belts 202 and 204, path 206, and discharge rollers 205. In the multiple copy mode, the sheet is discharged to the intermediate tray 200 by a diverter 203. Reference numerals 209 and 210 denote semilunar rollers to convey the sheet; 211, a separation roller pair; and 213, 214, and 215, conveyance rollers to convey the sheet to the registration rollers 106.

[Communication Method Between Apparatuses]

Figure 8:
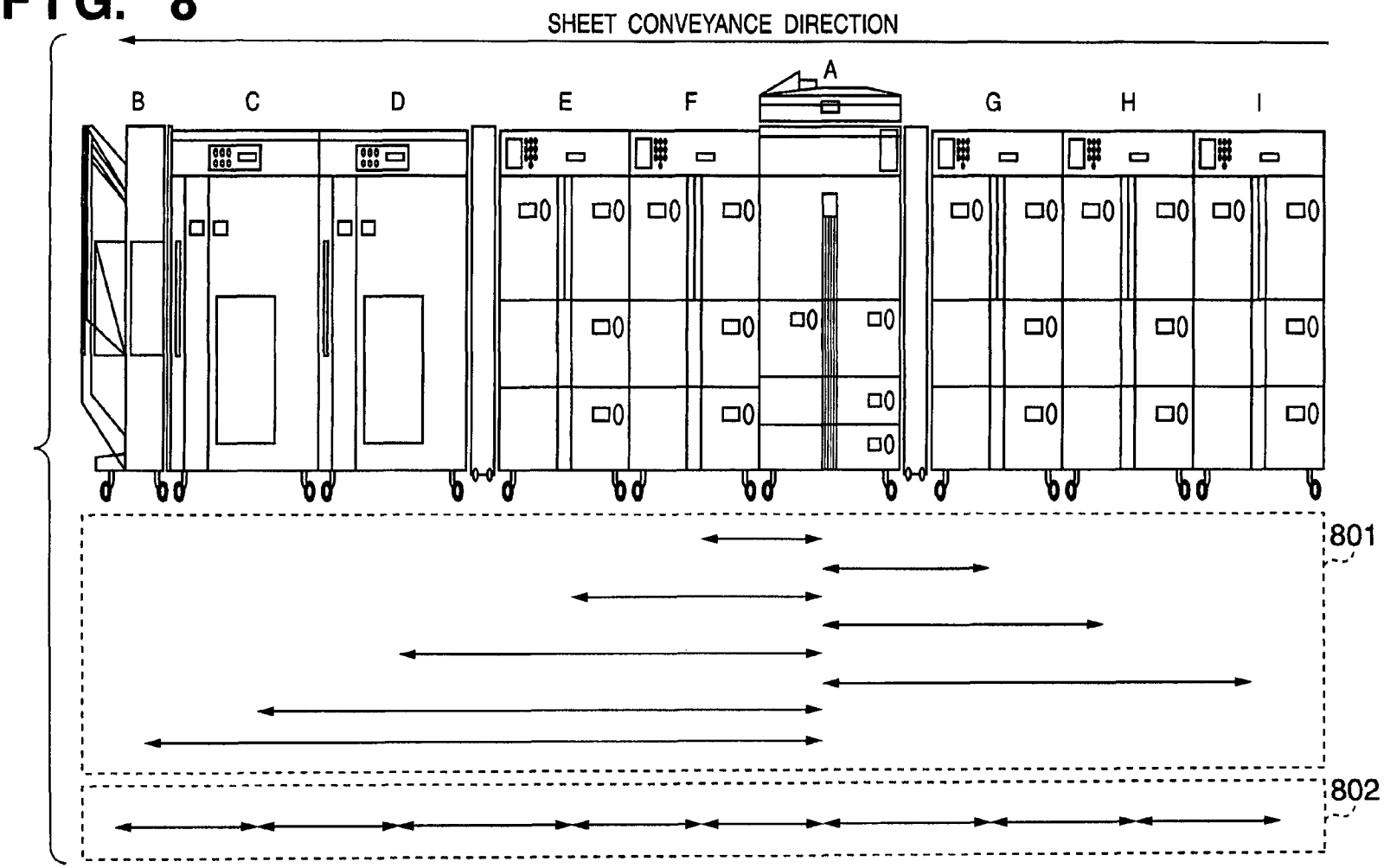
FIG. 8 is a view showing a system configuration according to the embodiment.

The communication method in the sheet conveyance system will be described next with reference to FIGS. 8 to 10. FIG. 8 is a view showing that the sheet conveyance system includes a plurality of apparatuses. Commands exchanged between the apparatuses in the system configuration are indicated by arrows 801 and 802. Each apparatus has a control means for controlling a plurality of communication channels in accordance with the number of partner apparatuses as a data transmission or reception target or the data type. In this embodiment, ARCNET (Attached Resource Computer NETwork) is used as a protocol or built a network. The driver unit (control IC) in the ARCNET functions as the control means. The driver unit has a plurality of channels and can assign each channel for transmission or reception by software setting.

Referring to FIG. 8, A indicates a printer engine; B, sorter 122; C and D, stackers; E and F, inserters; and G, H, and I, feed decks. In FIG. 8, the cassettes 100 and 102 in FIG. 2 are detached, and the decks G, H, and I are connected. Feed from the feed decks G, H, and I can be done by using the cassette feed ports 100 and 102.

The arrow 801 indicates a command exchanged between adjacent apparatuses. This command synchronizes with a sheet and requires a high command response speed. The arrow 802 indicates a command exchanged between the engine (=apparatus A) and the ACCs (=apparatuses B to I). This command does not so synchronize with a sheet and makes no great account of the command response speed. Actual sheet conveyance is done in a direction indicated by an arrow on the upper side.

Figure 9:
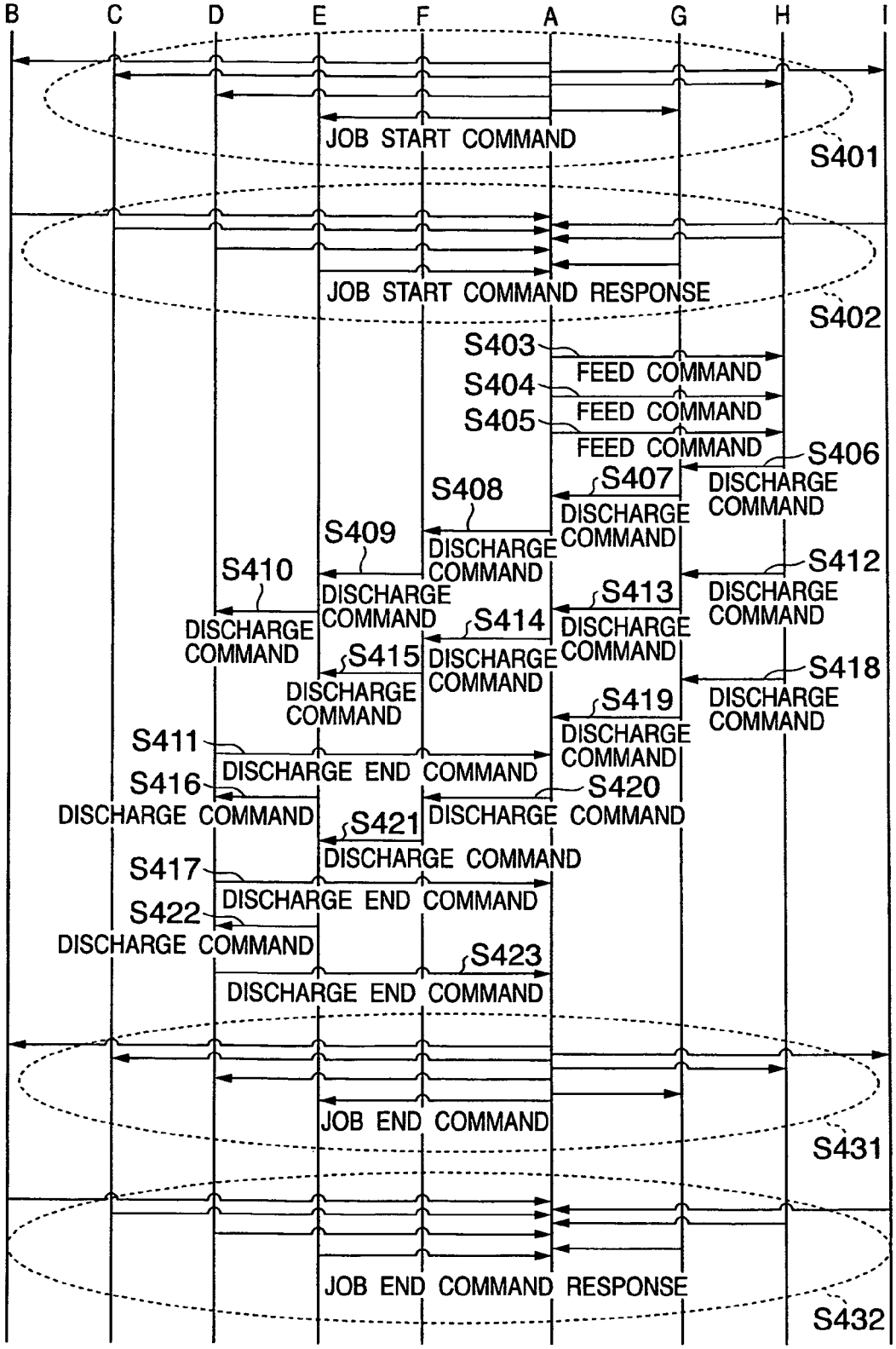
FIG. 9 is a view showing command exchange between the systems according to the embodiment in a normal state.

FIG. 9 is a view showing command exchange when three sheets are fed from the apparatus H serving as a feed source and discharged to the apparatus D serving as a discharge destination. A job start command S401 is transmitted from the engine to each ACC. This corresponds to the arrow 802 in FIG. 8. After S401 is executed, the engine receives a job start command response S402 from each ACC. This also corresponds to the arrow 802 in FIG. 8. S401 and S402 indicate that the job is to be executed for each ACC. It defines that each ACC side conveys sheets while guaranteeing job reception.

The apparatus A transmits feed commands (S403, S404, and S405) for three sheets to the apparatus H as a feed source. The feed commands correspond to the arrow 802 in FIG. 8.

Upon receiving the feed commands, the apparatus H conveys sheets from a sheet tray (not shown) set in it. The apparatus H conveys three sheets at a predetermined sheet interval. In discharging (=transferring) a sheet from the apparatus H to the apparatus G, a discharge command S406 is transmitted from the apparatus H to the apparatus G. The discharge command S406 synchronizes with the sheet and corresponds to the arrow 801 in FIG. 8. Upon receiving the discharge command S406 from the apparatus H, the apparatus G receives the sheet and further conveys it downstream (=discharge direction). In sheet transfer, not only the discharge command but also a discharge command response is transmitted because the adjacent apparatuses execute hand shake, although not illustrated (the discharge command response will be omitted here, and the same will apply hereinafter).

Next, a discharge command S407 is transmitted from the apparatus G to the apparatus A. The discharge command S407 synchronizes with the sheet and corresponds to the arrow 801 in FIG. 8. Upon receiving the discharge command S407 from the apparatus G, the engine receives the sheet and further conveys it downstream (=discharge direction). After a predetermined feed interval, the apparatus G receives a discharge command S412 from the apparatus H. Upon receiving the discharge command S412 from the apparatus H, the apparatus G receives the sheet and further conveys it downstream (=discharge direction), like S406. Similarly, upon receiving a discharge command S418 from the apparatus H after a predetermined feed interval, the apparatus G receives the sheet and further conveys it downstream (=discharge direction), like S406 and S412. The discharge commands S412 and S418 correspond to the arrow 801 in FIG. 8, like S406.

Next, a discharge command S408 is transmitted from the apparatus A to the apparatus F. The discharge command S408 synchronizes with the sheet and corresponds to the arrow 801 in FIG. 8. Upon receiving the discharge command S408 from the apparatus A, the apparatus F receives the sheet and further conveys it downstream (=discharge direction). After a predetermined feed interval, the apparatus A receives a discharge command S413 from the apparatus G. Upon receiving the discharge command S413 from the apparatus G, the apparatus A receives the sheet and further conveys it downstream (=discharge direction), like S407. Similarly, upon receiving a discharge command S419 from the apparatus G after a predetermined feed interval, the apparatus A receives the sheet and further conveys it downstream (=discharge direction), like S407 and S413. The discharge commands S413 and S419 correspond to the arrow 801 in FIG. 8, like S407.

Next, a discharge command S409 is transmitted from the apparatus F to the apparatus E. The discharge command S409 synchronizes with the sheet and corresponds to the arrow 801 in FIG. 8. Upon receiving the discharge command S409 from the engine, the apparatus E receives the sheet and further conveys it downstream (=discharge direction). After a predetermined feed interval, the apparatus F receives a discharge command S414 from the apparatus A. Upon receiving the discharge command S414 from the engine, the apparatus F receives the sheet and further conveys it downstream (=discharge direction), like S408. Similarly, upon receiving a discharge command S420 from the apparatus A after a predetermined feed interval, the apparatus F receives the sheet and further conveys it downstream (=discharge direction), like S408 and S414. The discharge commands S414 and S420 correspond to the arrow 801 in FIG. 8, like S408.

Next, a discharge command S410 is transmitted from the apparatus E to the apparatus D. The discharge command S410 synchronizes with the sheet and corresponds to the arrow 801 in FIG. 8. Upon receiving the discharge command S410 from the apparatus E, the apparatus D receives the sheet and further conveys it downstream (=discharge direction). In this case, the apparatus D is designated as the discharge destination. Hence, the apparatus D stores the sheet in the stacker unit of its own (not shown). After a predetermined feed interval, the apparatus E receives a discharge command S415 from the apparatus F. Upon receiving the discharge command S415 from the apparatus F, the apparatus E receives the sheet and further conveys it downstream (=discharge direction), like S409. Similarly, upon receiving a discharge command S421 from the apparatus F after a predetermined feed interval, the apparatus E receives the sheet and further conveys it downstream (=discharge direction), like S409 and S415. The discharge commands S415 and S421 correspond to the arrow 801 in FIG. 8, like S409.

Next, a discharge end command s411 is transmitted from the apparatus D to the apparatus A. The discharge end command S411 synchronizes with the sheet but is no command for sheet conveyance. Hence, S411 corresponds to the arrow 802 in FIG. 8. Upon receiving the discharge end command S411 from the apparatus D, the apparatus A determines that sheet discharge is normally ended. After a predetermined feed interval, the apparatus D receives a discharge command S416 from the apparatus E. Upon receiving the discharge command S416 from the apparatus E, the apparatus D receives the sheet and stores it in the stacker unit of its own (not shown) because the apparatus D is designated as the discharge destination, like S410. Similarly, upon receiving a discharge command S422 from the apparatus E after a predetermined feed interval, the apparatus D receives the sheet and stores it in the stacker unit of its own (not shown) because the apparatus D is designated as the discharge destination, like S410 and S416. The discharge commands S416 and S422 correspond to the arrow 801 in FIG. 8, like S410.

When the sheets received in S416 and S422 are stored in the stacker unit of its own, the apparatus D transmits discharge end commands S417 and S423 to the apparatus A, like S411. Upon receiving the discharge end commands S417 and S423 from the apparatus D, the apparatus A determines that discharge of the sheets is normally ended.

When determining that all fed sheets are discharged (=all discharge end commands are returned), the apparatus A transmits a job end command S431 to each ACC. This corresponds to the arrow 802 in FIG. 8. After S431 is executed, the apparatus A receives a job end command response S432 from each ACC. This also corresponds to the arrow 802 in FIG. 8. S431 and S432 notify each ACC of the end of the job.

Figure 10:
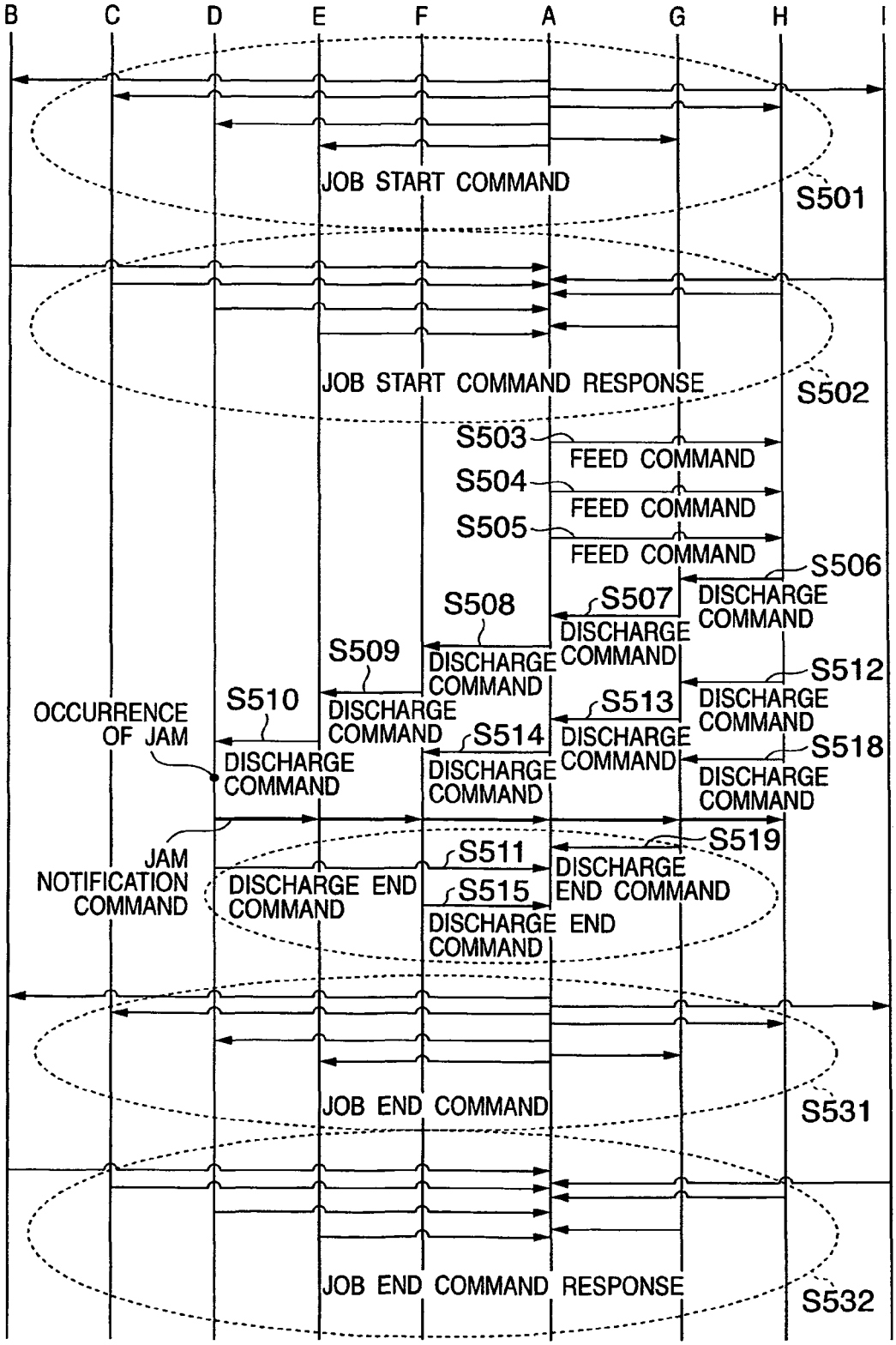
FIG. 10 is a view showing command exchange between the systems according to the embodiment in an abnormal state.

FIG. 10 is a view showing command exchange when a jam occurs in printing three sheets and, more specifically, when three sheets are fed from the apparatus H serving as a sheet feed source and discharged to the apparatus D serving as a discharge destination. The operation is the same as in FIG. 9 until occurrence of a jam, and this will be described briefly. A job start command S501 is transmitted from the apparatus A to each ACC. After S501 is executed, the apparatus A receives a job start command response S502 from each ACC.

The apparatus A transmits feed commands (S503, S504, and S505) for three sheets to the apparatus H as a feed source. Upon receiving the feed commands, the apparatus H conveys sheets from a sheet tray (not shown) set in it. The apparatus H conveys three sheets at a predetermined sheet interval. In transferring a sheet from the apparatus H to the apparatus G, a discharge command S506 is transmitted from the apparatus H to the apparatus G. Upon receiving the discharge command S506 from the apparatus H, the apparatus G receives the sheet and further conveys it downstream (=discharge direction).

Next, a discharge command S507 is transmitted from the apparatus G to the apparatus A. Upon receiving the discharge command S507 from the apparatus G, the apparatus A receives the sheet and further conveys it downstream (=discharge direction). After a predetermined feed interval, the apparatus G receives a discharge command S512 from the apparatus H. Upon receiving the discharge command S512 from the apparatus H, the apparatus G receives the sheet and further conveys it downstream (=discharge direction), like S506. Similarly, upon receiving a discharge command S518 from the apparatus H after a predetermined feed interval, the apparatus G receives the sheet and further conveys it downstream (=discharge direction), like S506 and S512.

Next, a discharge command S508 is transmitted from the apparatus A to the apparatus F. Upon receiving the discharge command S508 from the apparatus A, the apparatus F receives the sheet and further conveys it downstream (=discharge direction). After a predetermined feed interval, the apparatus A receives a discharge command S513 from the apparatus G. Upon receiving the discharge command S513 from the apparatus G, the apparatus A receives the sheet and further conveys it downstream (=discharge direction), like S507.

Next, a discharge command S509 is transmitted from the apparatus F to the apparatus E. Upon receiving the discharge command S509 from the apparatus A, the apparatus E receives the sheet and further conveys it downstream (=discharge direction). After a predetermined feed interval, the apparatus F receives a discharge command S514 from the apparatus A. Upon receiving the discharge command S514 from the apparatus A, the apparatus F receives the sheet and further conveys it downstream (=discharge direction), like S508.

Next, a discharge command S510 is transmitted from the apparatus E to the apparatus D. Upon receiving the discharge command S510 from the apparatus E, the apparatus D receives the sheet and further conveys it downstream (=discharge direction). In this case, the apparatus D is designated as the discharge destination. Hence, the apparatus D stores the sheet in the stacker unit of its own (not shown).

A jam occurs in the apparatus D during sheet conveyance corresponding to the discharge command S510. When the jam occurs, a jam notification command is transmitted to the upstream apparatuses by bucket brigade. The jam notification command is a highly urgent command transmitted between the apparatuses and corresponds to the arrow 801 in FIG. 8. If sheet conveyance is continued in case of jam occurrence in a downstream apparatus, the sheet may be sent into the apparatus with jam to increase the damage of jam. To prevent such increase of damage, the jam notification command is transmitted. Upon receiving the jam notification command, each apparatus stops sheet conveyance where it is convenient, thereby preventing the jam from spreading. When sheet conveyance is stopped, the apparatuses transmit discharge end commands (S511, S515, and S519) to the apparatus A. Upon receiving the discharge end commands S511, S515, and S519 from the apparatuses, the apparatus A determines that all sheets being conveyed are stopped. In this case, the discharge end commands S511, S515, and S519 are assumed to be transmitted to the apparatus A intensively all at once.

When determining that all fed sheets are discharged (=all discharge end commands are returned), the apparatus A transmits a job end command S531 to each ACC. This corresponds to the arrow 802 in FIG. 8. After S531 is executed, the apparatus A receives a job end command response S532 from each ACC. This also corresponds to the arrow 802 in FIG. 8. S531 and S532 notify each ACC of the end of the job. If a discharge end command is returned due to a jam, the apparatus A determines on the basis of an ACC status notification from each ACC whether the jam is solved and executes processing such as recovery.

Figure 7:
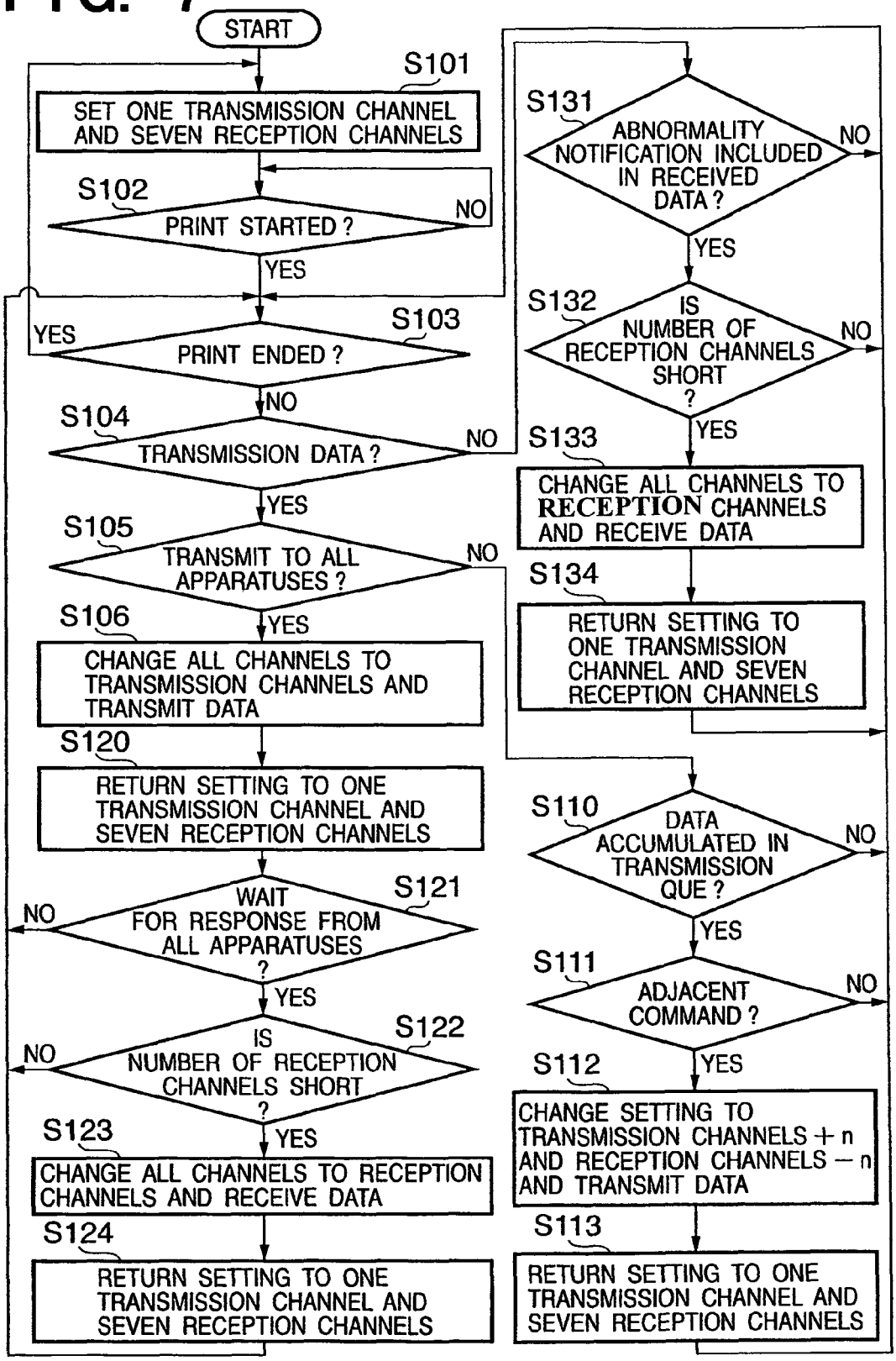
FIG. 7 is a flowchart of a main sequence according to the embodiment.

Transmission/reception channel assignment control processing will be described next with reference to the flowchart in FIG. 7. A supplementary explanation of the transmission/reception assignment state will be done with reference to FIGS. 11, 12, and 13.

In step S101, one of a total of eight transmission/reception channels is assigned to transmission, and the seven remaining channels are assigned to reception as default channel assignment. This default setting is based on the setting of 1-to-N communication. That is, FIFO transmission is executed through one channel while always enabling reception from a plurality of apparatus.

In step S102, it is determined whether printing is started. Whether printing is started is determined on the basis of the transmission/reception state of the job start command in FIG. 9 or 10 described above.

Figure 12:
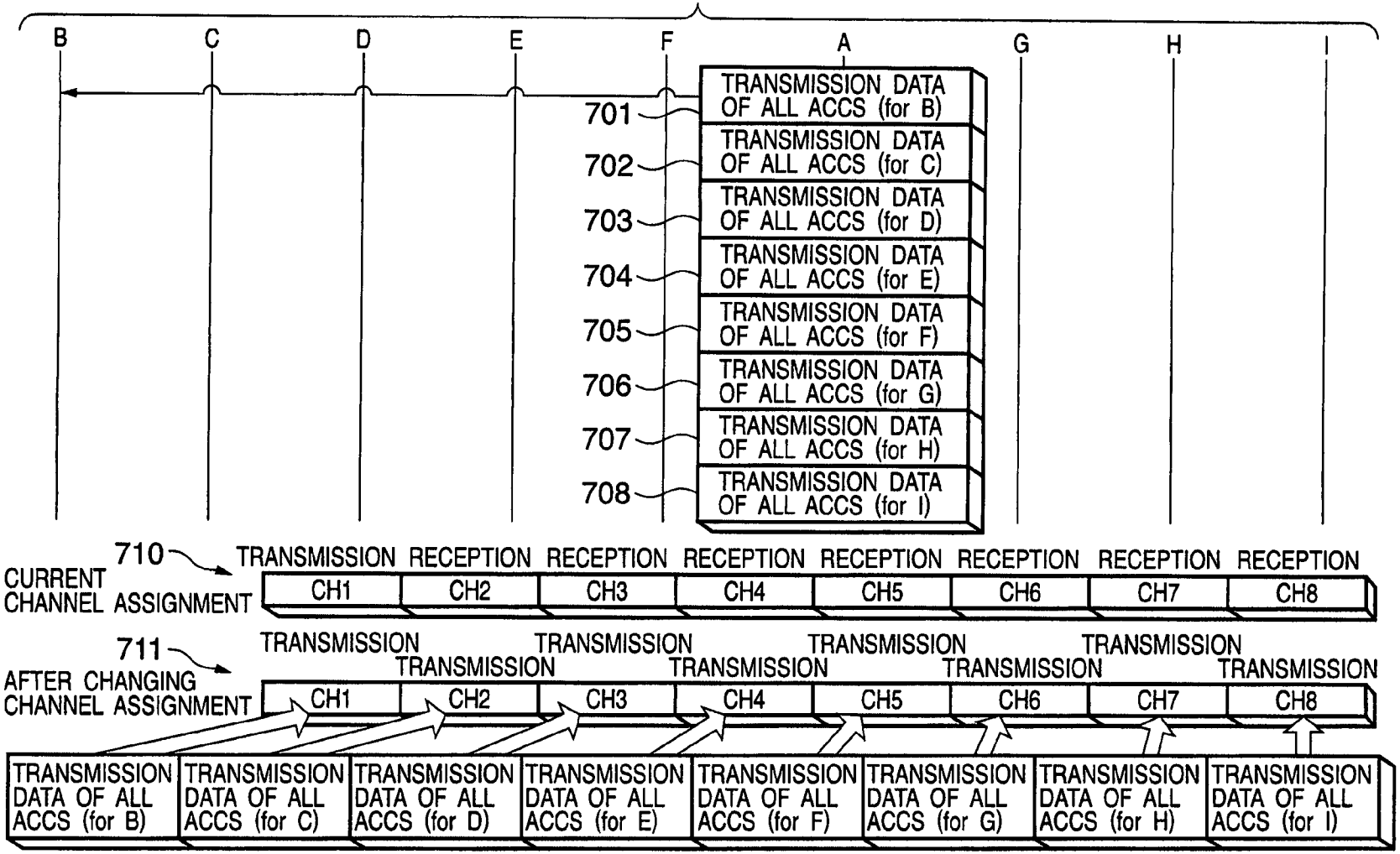
FIG. 12 is a view showing transmission data and transmission/reception port assignment in the apparatus according to the embodiment.

In step S103, it is determined whether printing started in step S102 is ended. Whether printing is ended is determined on the basis of the transmission/reception state of the job end command in FIG. 9 or 10 described above. If NO in step S103, it is determined in step S104 whether transmission data from the current apparatus to another apparatus is present. If YES in step S104, the flow advances to step S105. If NO in step S104, the flow advances to step S131. In step S105, it is determined whether to transmit the transmission data from the current apparatus to all the remaining apparatuses. If YES in step S105, the flow advances to step S106. If NO in step S105, the flow advances to step S110. Step S106 will be described with reference to FIG. 12 together. FIG. 12 shows the situation in the apparatus A. The situation shown in FIG. 12 corresponds to transmission of a job start command or job end command in FIG. 9 or 10 described above. Transmission data 701 to 708 exist as one transmission data for one destination. In this case, in the current transmission/reception channel assignment setting, CH1 is a transmission channel, and CH2 to CH8 are reception channels, as indicated by 710. In the processing in step S106, the transmission/reception channel assignment setting is changed to set all the CH1 to CH8 to transmission channels. The transmission data 701 to 708 are distributed to these channels and transmitted. In step S120 following step S106, the transmission/reception channel assignment is returned to the default setting (one transmission channel and seven reception channels) in step S101.

In step S121 following step S120, it is determined whether to wait for responses from all apparatuses.

Figure 13:
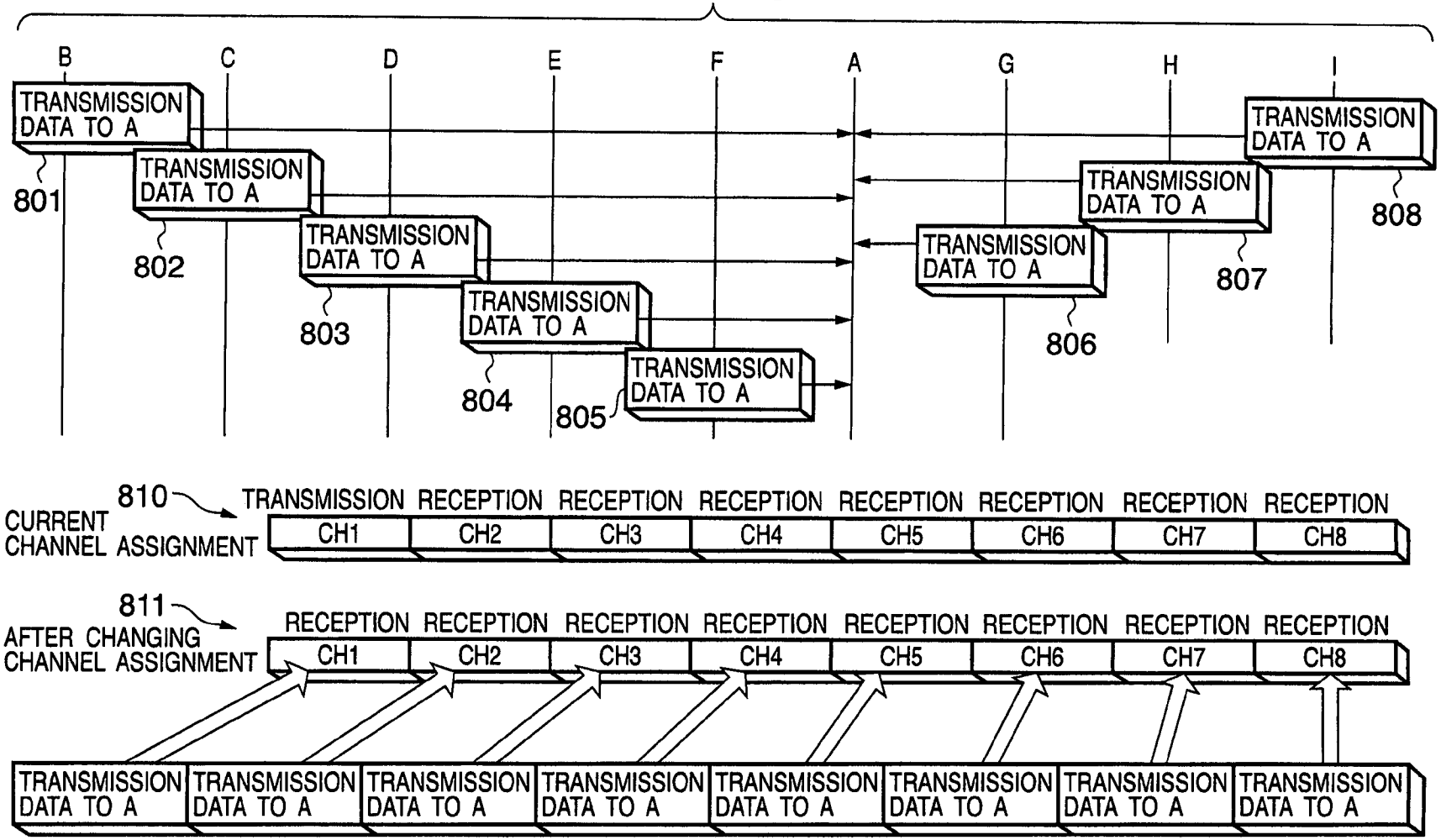
FIG. 13 is a view showing transmission data and transmission/reception port assignment in the apparatus according to the embodiment.

The processing in step S121 will be described with reference to FIG. 13 together. FIG. 13 shows the situation in the apparatus A. The situation shown in FIG. 13 corresponds to wait for a job start command response after transmission of a job start command or wait for a job end command response after transmission of a job end command in FIG. 9 or 10 described above. That is, it is known in this situation that responses should be returned from all apparatuses in command exchange by the protocol. In step S121, whether to wait for responses from all apparatuses is determined depending on whether the situation shown in FIG. 13 can be predicted. That is, a situation is assumed in which transmission data 801 to 808 exist as one transmission data for one destination (=apparatus A). If YES in step S121, the flow advances to step S122. If NO in step S121, the flow returns to step S103. In step S122, it is determined whether the current number of reception channels suffices for the number of receptions of responses from all apparatuses in step S122. The example shown in FIG. 13 assumes that the number of channels assigned to reception is seven, and the number of receptions of responses from all apparatuses is eight. It is hence determined in step S121 that the current number of reception channels is short, and the flow advances to step S123. If it is determined in step S121 that the current number of reception channels suffices, and the flow returns to step S103.

In the current transmission/reception channel assignment setting, CH1 is a transmission channel, and CH2 to CH8 are reception channels, as indicated by 810. In the processing in step S123, the transmission/reception channel assignment setting is changed to set all the CH1 to CH8 to reception channels. The reception data 801 to 808 are distributed to these channels and received. In step S124 following step S123, the transmission/reception channel assignment is returned to the default setting (one transmission channel and seven reception channels) in step S101, and the flow returns to step S103.

Figure 11:
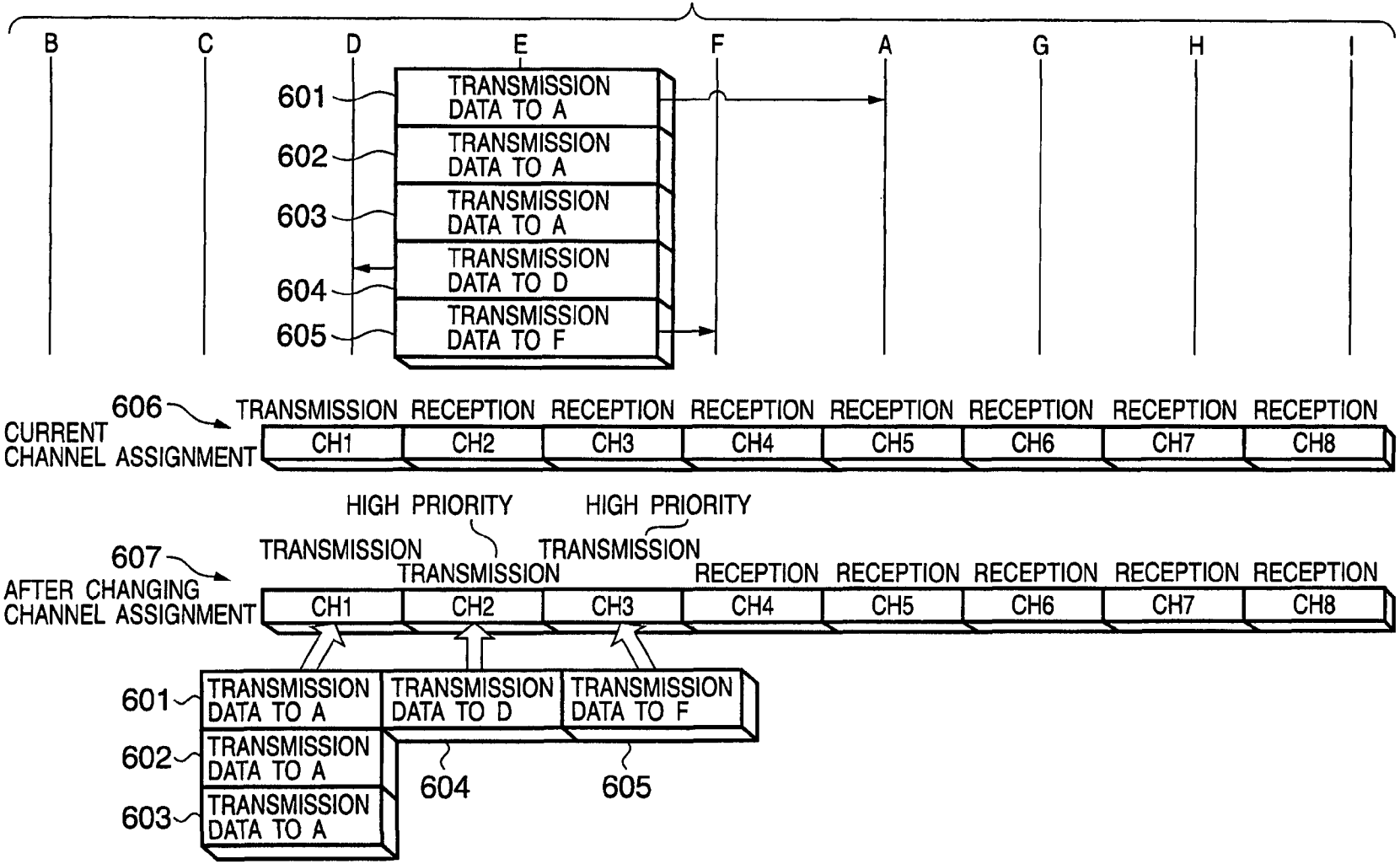
FIG. 11 is a view showing transmission data and transmission/reception port assignment in the apparatus according to the embodiment.

The processing in steps S110 to S113 will be described with reference to FIG. 11 together. FIG. 11 shows the situation in the apparatus E. Reference numerals 601 to 603 denote transmission data (feed command, discharge end command, and status command) to the apparatus A; and 604 and 605, transmission data (e.g., discharge command and abnormality detection command) between adjacent apparatuses.

In step S110, it is determined whether transmission data are in the QUE (=queue). When only CH1 is a transmission channel, and CH2 to CH8 are reception channels in the current transmission/reception channel assignment setting, as indicated by 606 in FIG. 11, only the transmission data 601 is transmitted. The transmission data 602 to 605 still wait for transmission processing. If YES in step S110, the flow advances to step S111. If NO in step S110, the flow returns to step S103. In step S111, it is determined whether the data in the transmission QUE include a command between adjacent apparatuses.

A command between adjacent apparatuses corresponds to the arrow 801 in FIG. 8 or the transmission data 604 and 605 in FIG. 11. The command between adjacent apparatuses synchronizes with a sheet and requires a high command response speed. Hence, it is not preferable that a plurality of commands between adjacent apparatuses are present in the QUE. If YES in step S111, the flow advances to step S112 to change the assignment of the number of transmission/reception channels (=the number of transmission channels is increased, and the number of reception channels is decreased by the same number). In this situation, the number of transmission channels indicated by 606 is increased by the number of destinations of the adjacent commands in the QUE, as indicated by 607. The transmission data 604 and 605 in the QUE are distributed to CH2 and CH3 and transmitted preferentially. Preferentially transmitting data means that in a hardware configuration that executes, e.g., one transmission processing using only one transmission channel, transmission by CH2 and CH3 is executed with a higher priority over transmission using CH1.

If NO in step S111, the flow returns to step S103. When the transmission processing in step S112 is ended, the flow advances to step S113. The transmission/reception channel assignment is returned to the default setting (one transmission channel and seven reception channels) in step S101, and the flow returns to step S103.

In step S131, it is determined whether the received data include an abnormality notification command. This corresponds to the jam notification command in FIG. 10. Except the jam, the abnormality notification command corresponds to an alarm notification command or error notification command (not shown). If YES in step S131, the flow advances to step S132. In step S132, it is determined whether the current number of reception channels suffices for the expected number of data to be received. In the example shown in FIG. 10, when three feed commands are issued, three discharge end commands are waited. It is determined whether the number of reception channels suffices for the number of discharge end commands (=expected number of data to be received). In the example shown in FIG. 13, the number of reception channels is seven, as indicated by 810, and suffices for the expected number (three) of data to be received. If it is determined in step S132 that the current number of reception channels is short, and the flow advances to step S133. If it is determined in step S132 that the current number of reception channels suffices, and the flow returns to step S103. In step S133, the assignment is changed to set all channels to reception channels, as indicated by 811 in FIG. 13, and data is received from each ACC. The contents of receptions from the ACCs are assumed to be that the discharge end commands which are all returned with respect to the transmitted feed commands to determine that all sheets being conveyed are stopped, as described in FIG. 10. When reception in step S133 is ended, in step S134, the transmission/reception channel assignment is returned to the default setting (one transmission channel and seven reception channels) in step S101, and the flow returns to step S103.

As described above, according to this embodiment, in a system characterized by connecting a plurality of apparatuses each including a communication means with a plurality of communication channels and conveying sheets between the apparatuses, each of the plurality of communication channels can be switched between the transmission mode and the reception mode.

When a plurality of transmission channels are set by channel assignment, communication can be done by giving a priority to a transmission destination. If transmission data are accumulated in an apparatus, and they include data for a transmission destination with a higher priority over the current data transmission destination, the number of transmission channels is increased, and the priority is raised. Hence, a command response corresponding to a transmission data type can be implemented.

If command reception for all apparatuses is expected, the number of reception channels in the apparatus is increased, thereby preventing reception overflow caused by concentration of transmission from the apparatuses to a specific apparatus.

That is, in a system with a network connection in which apparatuses execute 1-to-N communication, if concentration of transmission from the apparatuses to a specific apparatus is expected to occur, the number of assigned reception channels is increased in advance to prevent reception overflow. If transmission data designates a plurality of destinations, the number of assigned transmission channels is increased to improve the transmission performance.

When a plurality of transmission data are in the transmission queue, and the transmission data in the transmission queue include data for a destination with a higher priority over the current transmission destination, the number of transmission channels is increased, or the priority of the transmission channel is raised. Hence, a command response corresponding to a transmission data type can be implemented.

Second Embodiment

Figure 14:
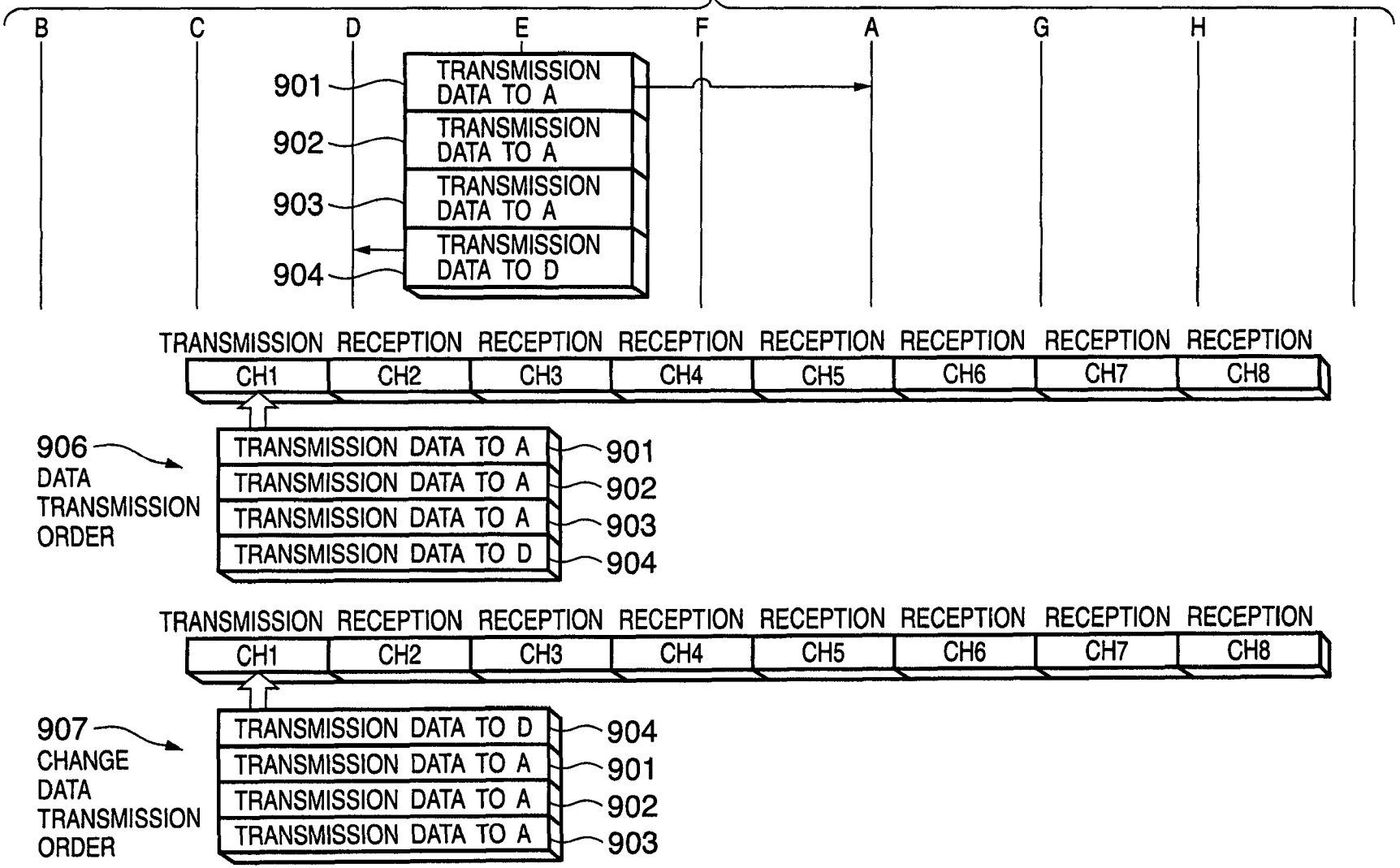
FIG. 14 is a view showing replacement of transmission data in the apparatus according to the embodiment.

As the case shown in FIG. 11 wherein transmission data are caused to wait, another embodiment will be described with reference to FIG. 14. In the example shown in FIG. 14, data in the transmission QUE include one command between adjacent apparatuses, unlike the example shown in FIG. 11. In this example, a current transmission data order 906 is changed to a transmission data order 907. That is, transmission data 901 which is being transmitted currently is stopped, and transmission data 904 is transmitted as an interrupt. Even in the operation at this time, a command between adjacent apparatuses with a high priority can be transmitted preferentially.

Other Embodiment

The embodiments of the present invention have been described above in detail. The present invention can be applied to a system including a plurality of devices or to an apparatus including a single device.

The present invention is achieved even by supplying a program to implement the functions of the above-described embodiments to the system or apparatus directly or from a remote site and causing the system or apparatus to read out and execute the supplied program code. Hence, the program code itself which is installed in a computer to implement the functional processing of the present invention by the computer is also incorporated in the claim of the present invention.

In this case, the program can take any form such as an object code, a program to be executed by an interpreter, or script data to be supplied to the OS if the functions of the program can be obtained.

As a recording medium to supply the program, for example, a Floppy® disk, hard disk, optical disk, magnetooptical disk, MO, CD-ROM, CD-R, CD-RW, magnetic tape, nonvolatile memory card, ROM, or DVD (DVD-ROM or DVD-R) can be used.

As another program supply method, a client computer may be connected to a homepage on the Internet using a browser in the computer, and the computer program itself of the present invention or a compressed file containing an automatic install function may be downloaded from the homepage to a recording medium such as a hard disk. A program code that constitutes the program of the present invention may be divided into a plurality of files, and the files may be downloaded from different homepages. That is, a WWW server which causes a plurality of users to download a program file that causes a computer to implement the functional processing of the present invention is also incorporated in the claim of the present invention.

The program of the present invention may be encrypted, stored in a storage medium such as a CD-ROM, and distributed to users. Any user who satisfies predetermined conditions may be allowed to download key information for decryption from a homepage through the Internet, execute the encrypted program using the key information, and install the program in the computer.

The functions of the above-described embodiments are implemented not only when the readout program is executed by the computer but also when the OS running on the computer performs part or all of actual processing on the basis of the instructions of the program.

The functions of the above-described embodiments are also implemented when the program read out from the recording medium is written in a memory provided on a function expansion board inserted into the computer or a function expansion unit connected to the computer, and the CPU provided on the function expansion board or function expansion unit performs part or all of actual processing on the basis of the instructions of the program.

As many apparently widely different embodiments of the present invention can be made without departing from the spirit and scope thereof, it is to be understood that the invention is not limited to the specific embodiments thereof except as defined in the claims.

This application claims the benefit of Japanese Patent Application No. 2005-091855 filed on Mar. 28, 2005, which is hereby incorporated by reference herein its entirety.

What is claimed is:

1. A sheet conveyance system which includes a plurality of apparatuses, each of the apparatuses comprising:

a plurality of communication channels for communicating sheet transfer data to another one of the plurality of apparatuses and capable of being switched between a transmission mode and a reception mode;

a determination unit adapted to determine whether or not a plurality of untransmitted data are present in the apparatus; and a control unit adapted to change a setting of the reception mode of a communication channel among the plurality of communication channels into a setting of the transmission mode when said determination unit determines that the plurality of untransmitted data are present in the apparatus, wherein said control unit transmits the plurality of untransmitted data using the communication channel to which the transmission mode is set.

2. The system according to claim 1, wherein each of the apparatuses is adapted to transmit the sheet transfer data to notify an adjacent apparatus of transfer of a sheet in the transmission mode, and when a plurality of sheet transfer data are present in the apparatus, said control unit changes the communication channel set in the reception mode to the transmission mode.

3. The system according to claim 2, wherein said control unit changes communication channels set in the reception mode, which are equal in number to transmission partners of the sheet transfer data, to the transmission mode.

4. The system according to claim 1, wherein each of the communication channels is given a priority and executes communication, and said control unit raises the priority of the communication channel changed to the transmission mode.

5. The system according to claim 1, wherein each of the apparatuses is adapted to transmit the sheet transfer data to notify an adjacent apparatus of transfer of a sheet in the transmission mode, and further comprises a determination unit adapted to determine whether a plurality of untransmitted data are present in the apparatus, and when the plurality of untransmitted data are present in the apparatus, and the untransmitted data include the sheet transfer data, said control unit raises a transmission priority of the sheet transfer data and transmits the sheet transfer data.

6. The system according to claim 5, wherein when data which is being transmitted is not the sheet transfer data, and untransmitted data include the sheet transfer data, said control unit stops transmission and transmits the sheet transfer data first.

7. The system according to claim 1, wherein when status data indicating occurrence of an abnormality is received, said control unit changes a communication channel set in the transmission mode to the reception mode.

8. The system according to claim 7, wherein each of the apparatuses further comprises a determination unit adapted to determine whether the number of data receptions from the remaining apparatuses is larger than the number of channels set in the reception mode, and if it is determined that the number of data receptions from the remaining apparatuses is larger than the number of channels set in the reception mode, said control unit changes a channel set in the transmission mode to the reception mode.

* * * * *